US009195173B2

(12) United States Patent
Ogawa et al.

(10) Patent No.: US 9,195,173 B2
(45) Date of Patent: Nov. 24, 2015

(54) DEVELOPING DEVICE AND IMAGE FORMING APPARATUS AND PROCESS CARTRIDGE INCORPORATING SAME

(71) Applicants: Tadashi Ogawa, Tokyo (JP); Atsushi Nakamoto, Kanagawa (JP)

(72) Inventors: Tadashi Ogawa, Tokyo (JP); Atsushi Nakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/293,018

(22) Filed: Jun. 2, 2014

(65) Prior Publication Data

US 2014/0376951 A1 Dec. 25, 2014

(30) Foreign Application Priority Data

Jun. 20, 2013 (JP) ..... 2013-129376

(51) Int. Cl.

*G03G 21/00* (2006.01)
*G03G 15/08* (2006.01)
*G03G 21/18* (2006.01)

(52) U.S. Cl.

CPC ..... *G03G 15/0898* (2013.01); *G03G 21/18* (2013.01)

(58) Field of Classification Search

CPC ..... G03G 15/0875; G03G 15/0877; G03G 15/0898

See application file for complete search history.

(56) References Cited

U.S. PATENT DOCUMENTS

| | | | | |
|---|---|---|---|---|
| 2006/0165443 | A1 | 7/2006 | Yoshinaga et al. | |
| 2006/0177232 | A1 | 8/2006 | Ehara et al. | |
| 2007/0003325 | A1* | 1/2007 | Jung et al. | 399/258 |
| 2007/0059011 | A1 | 3/2007 | Seo et al. | |
| 2007/0242988 | A1 | 10/2007 | Seo et al. | |
| 2011/0091253 | A1 | 4/2011 | Seo et al. | |
| 2011/0129262 | A1 | 6/2011 | Nakamoto | |
| 2011/0217085 | A1 | 9/2011 | Hattori et al. | |
| 2012/0093531 | A1 | 4/2012 | Yuasa et al. | |
| 2012/0107005 | A1 | 5/2012 | Hase et al. | |
| 2012/0118834 | A1* | 5/2012 | Gier-Zucketto et al. | 210/767 |
| 2012/0163874 | A1 | 6/2012 | Hattori et al. | |
| 2012/0219326 | A1 | 8/2012 | Koike et al. | |
| 2013/0034368 | A1 | 2/2013 | Hattori et al. | |
| 2013/0209115 | A1 | 8/2013 | Hase et al. | |
| 2014/0270838 | A1* | 9/2014 | Yoshizawa et al. | 399/99 |

FOREIGN PATENT DOCUMENTS

| | | |
|---|---|---|
| JP | 61-159676 | 7/1986 |
| JP | 2007-248629 | 9/2007 |
| JP | 2012-189787 | 10/2012 |

* cited by examiner

*Primary Examiner* — Roy Y Yi
(74) *Attorney, Agent, or Firm* — Oblon, McClelland, Maier & Neustadt, L.L.P.

(57) ABSTRACT

A developing device includes a developer bearer to carry by rotation developer to a development range facing a latent image bearer, a developer container to contain developer and having a pressure-release vent to discharge air from the developer container to outside the developing device, and a filter provided to the pressure-release vent to inhibit developer from being discharged through the pressure-release vent. The filter includes a porous fluoroplastic film.

8 Claims, 6 Drawing Sheets

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2013-129376, filed on Jun. 20, 2013, in the Japan Patent Office, the entire disclosure of which is hereby incorporated by reference herein.

BACKGROUND

1. Technical Field

Embodiments of the present invention generally relate to a developing device, a process cartridge, and an image forming apparatus, such as a copier, a printer, a facsimile machine, or a multifunction machine having at least two of coping, printing, facsimile transmission, plotting, and scanning capabilities, that includes a developing device.

2. Description of the Related Art

Image forming apparatuses typically include a developing device to develop latent images formed on a latent image bearer (e.g., a photoreceptor) with developer, and two-component developer consisting essentially of toner (toner particles) and magnetic carrier (carrier particles) is widely used. Developing devices of this type typically include a rotatable developer bearer inside which multiple magnetic poles are provided. For example, JP-H06-019637-A, JP-2012-189787-A, and JP-2007-248629-A propose such configurations.

In such developing devices, the developer bearer carries developer on its surface and transports the developer to a development range facing the latent image bearer, where toner in the developer is supplied to the latent image on the surface of the latent image bearer.

The developer bearer is disposed in a casing serving as a developer container to contain developer, and the surface of the developer bearer is partly exposed in the development range through an opening of the casing. Inside the casing (i.e., the developer container), while developer is circulated by one or multiple developer conveyance members, a part of circulating developer is supplied to the surface of the developer bearer. The amount of developer supplied to the developer bearer is adjusted at a position where the developer bearer faces a developer regulator, after which the developer is transported to the development range. After the toner therein is consumed in the development range, the developer leaves the surface of the developer bearer. Then, the developer is collected in the developer container and circulated together with the developer therein.

To enable high-speed output in this developing device, the velocity at which the surface of the developer bearer moves (hereinafter "surface movement velocity") is increased. However, if the surface movement velocity is increased, it is possible that air pressure inside the developer container rises as follows.

The surface of the developer bearer moving at a high velocity causes airflow that follows the movement of the developer bearer. When the exposed surface of the developer bearer returns from the opening in the development range to inside the casing, air flows into the casing as well.

By contrast, on the surface of the developer bearer moving toward the development range, developer fills a gap (i.e., a regulation gap) between the developer regulator and the surface of the developer bearer, which inhibits air from flowing out from the opening together with the surface of the developer bearer.

In a state in which the casing is substantially filled with developer other than the opening, air pressure inside the developer container rises when air flows into the casing but does not flow out therefrom.

If air pressure rises inside the developer container, there arises a risk that toner scatters out together with air from a small clearance between the developer container and the developer bearer moving to the development range, seams of the developer container, or the like. Scattering of toner is not desirable since it causes stains on output images, contamination inside an image forming apparatus, and the like.

The patent documents listed above propose use of a pressure-release vent to discharge air from the developer container and a filter to inhibit passage of toner, thereby inhibiting toner scattering from the opening. In this configuration, pressure rise inside the developer container can be inhibited since air is released from the developer container. Accordingly, toner scattering resulting from the pressure rise inside the developer container can be suppressed.

SUMMARY

In view of the foregoing, one embodiment of the present invention provides a developing device that includes a developer bearer to carry by rotation developer to a development range facing a latent image bearer and supply developer to a latent image on the latent image bearer, a developer container to contain developer and having a pressure-release vent to discharge air from the developer container to outside the developing device, and a filter provided to the pressure-release vent to inhibit developer from being discharged through the pressure-release vent. The filter includes a porous fluoroplastic film.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
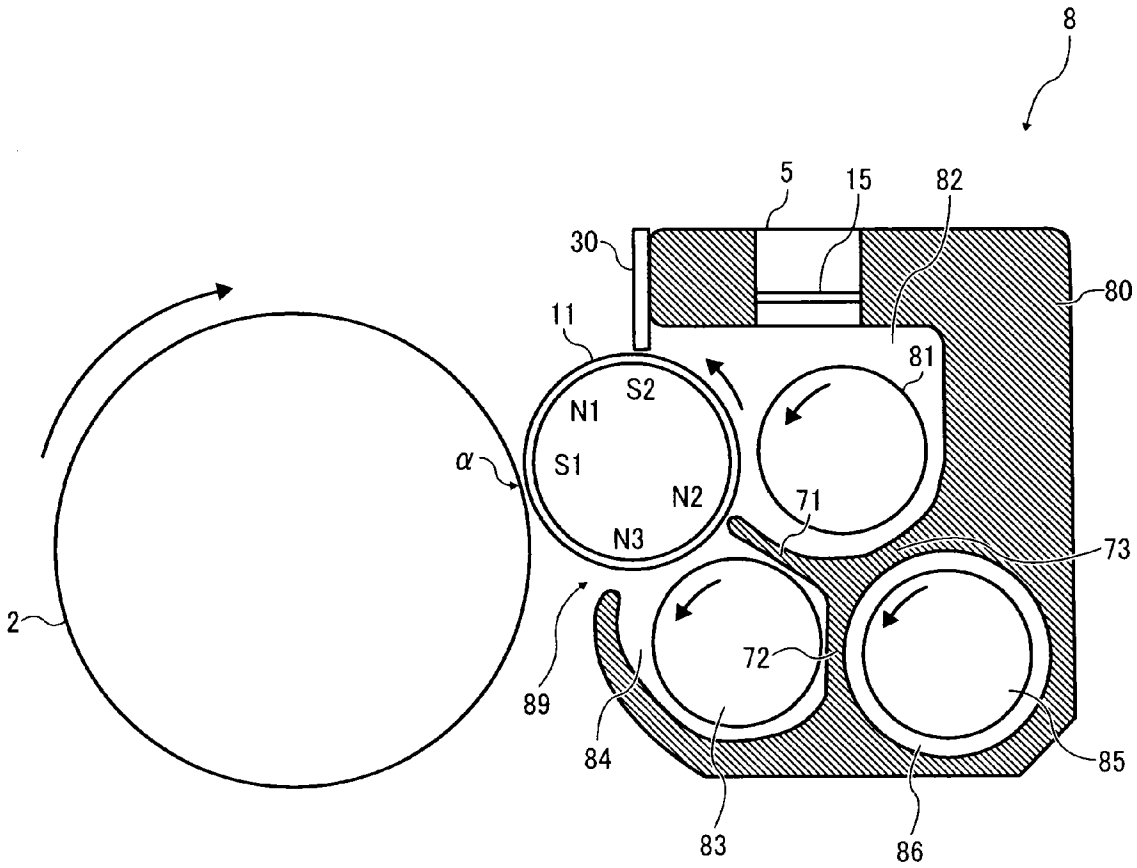
FIG. 1 is a cross-sectional view of a developing device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In developing devices including a filter provided to a pressure-release vent, it is possible that toner filtered thereby remains on the face (i.e., inner face) of the filter opposed to the interior of the developing device, and the toner accumulates on the filter, clogging the filter.

This inconvenience arises in developing devices employing one-component developer as well as in developing devices employing two-component developer.

In view of the foregoing, an aim of the embodiments described below is to provide a developing device capable of inhibiting clogging of the filter at the pressure-release vent, and a process cartridge and an image forming apparatus that include the developing device.

Referring now to the drawings, wherein like reference numerals designate identical or corresponding parts throughout the several views thereof, an embodiment of the present invention is described.

Figure 2:
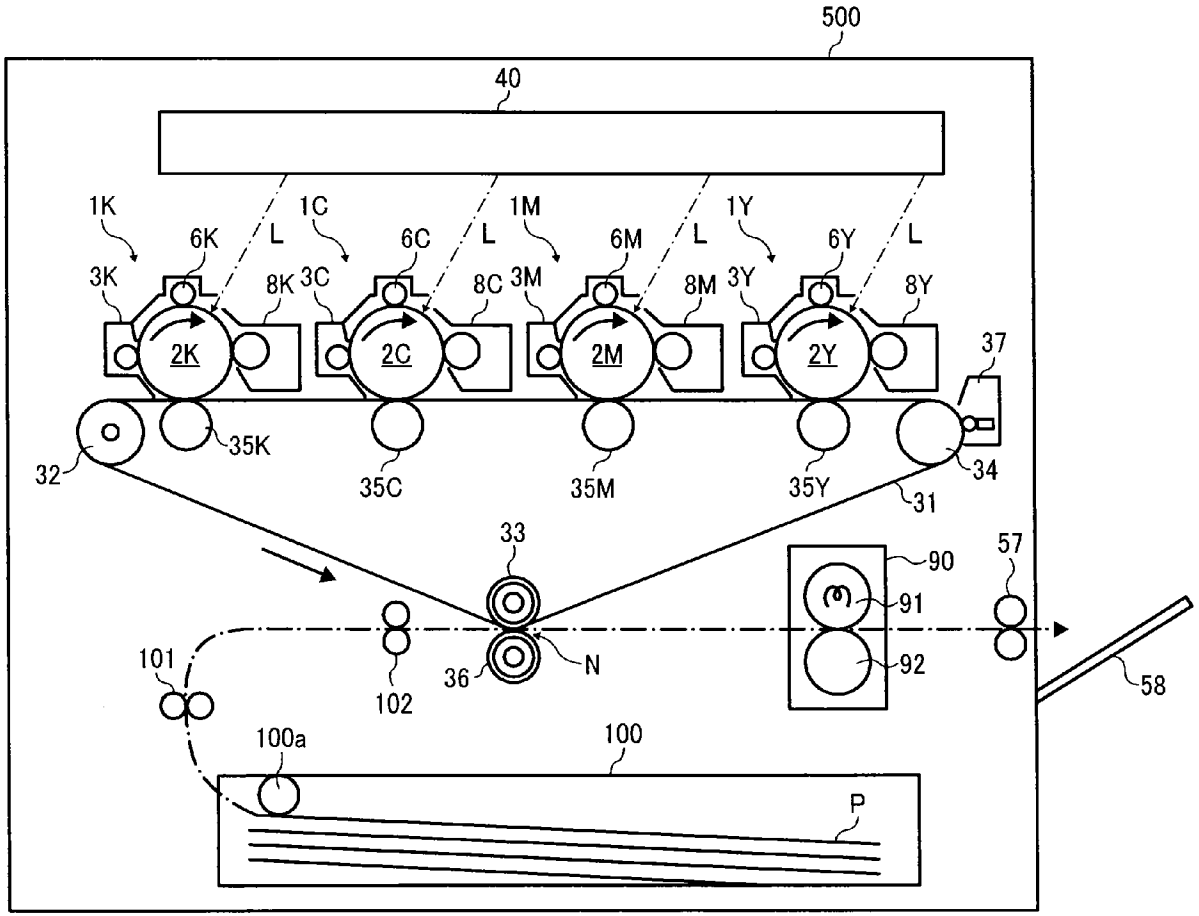
FIG. 2 is a schematic diagram of an image forming apparatus in which the developing device shown in FIG. 1 is incorporated.

FIG. 1 illustrates a photoreceptor 2 and a developing device 8 to which aspects of the present specification are applicable, and FIG. 2 is a schematic view of an image forming apparatus 500 that in the present embodiment is a multicolor printer, for example.

It is to be noted that suffixes Y, M, C, and K attached to each reference numeral indicate only that components indicated thereby are used for forming yellow, magenta, cyan, and black images, respectively, and hereinafter may be omitted when color discrimination is not necessary.

A configuration and operation of the image forming apparatus 500 is described below.

In the configuration shown in FIG. 2, the image forming apparatus 500 is a tandem-type printer and include multiple independent optical systems and latent image bearers for forming yellow, magenta, cyan, and black images. The image forming apparatus 500 transfers multiple color toner images from the respective latent image bearer and superimposes them on an intermediate transfer member. The superimposed toner image on the intermediate transfer member is then transferred onto a sheet serving as a recording medium, thereby forming a multicolor image.

The image forming apparatus 500 includes four image forming units 1Y, 1M, 1C, and 1K for forming yellow, magenta, cyan, and black toner images, respectively. Each image forming unit 1 includes a drum-shaped photoreceptor 2 serving as an image bearer or latent image bearer. The four photoreceptors 2 rotate clockwise in FIG. 2 as indicated by arrow shown in FIG. 2. Around the photoreceptor 2, a charging device 6 serving as a charging member, a developing device 8, and a cleaning device 3 are provided.

Additionally, an exposure device 40 is provided above the image forming units 1 in FIG. 2 to direct exposure light L onto the surface of the photoreceptor 2 positioned between the charging device 6 and the developing device 8 in each image forming unit 1.

The image forming unit 1 includes a common unit casing to support the photoreceptor 2, the developing device 8, and the cleaning device 3 together and is configured as a modular unit (i.e., a process cartridge) removably installable in an apparatus body of the image forming apparatus 500. It is to be noted that, alternatively, the developing device 8 and at least one of the photoreceptor 2, the charging device 6, and the cleaning device 3 may be united together as the process cartridge. Yet alternatively, at least two of the photoreceptor 2, the charging device 6, the developing device 8, and the cleaning device 3 may be united together as the process cartridge.

In the image forming apparatus 500, an endless intermediate transfer belt 31 serving as the intermediate transfer member is provided beneath the four image forming units 1 in FIG. 2. As shown in FIG. 2, the intermediate transfer belt 31 is looped around three rollers, namely, a driving roller 32, a secondary-transfer backup roller 33, and a cleaning backup roller 34, and rotatable counterclockwise in FIG. 2. At positions opposed to the four photoreceptors 2 via the intermediate transfer belt 31, primary-transfer rollers 35, serving as primary transfer members, are provided.

Beneath the intermediate transfer belt 31, a secondary-transfer roller 36, serving as a secondary transfer member, is provided. Among the three rollers supporting the intermediate transfer belt 31, the secondary-transfer backup roller 33 is in contact with the secondary-transfer roller 36 via the intermediate transfer belt 31. The contact portion between the intermediate transfer belt 31 and the secondary-transfer roller 36 serves as a secondary-transfer nip N where the toner image is transferred from the intermediate transfer belt 31 onto a sheet P.

Another one of the rollers supporting the intermediate transfer belt 31, the cleaning backup roller 34, is opposed, via the intermediate transfer belt 31, to an intermediate-transfer cleaner 37 to remove toner remaining on the intermediate transfer belt 31 after image transfer.

Beneath the secondary-transfer roller 36 in FIG. 2, a sheet tray 100 containing sheets P is provided. Broken lines shown in FIG. 2 represent a conveyance channel through which the sheet P is transported inside the image forming apparatus 500.

A fixing device 90 is disposed downstream from (on the right in FIG. 2) the secondary-transfer nip N in the direction in which the sheet P is transported (i.e., a sheet conveyance direction). The fixing device 90 includes a heating roller 91 inside which a heater is provided and a pressure roller 92 pressed against the heating roller 91 by a spring, forming a nip therebetween.

Next, multicolor image formation in the image forming apparatus 500 is described below.

To form images, the driving roller 32 is driven to rotate the intermediate transfer belt 31, and the other two rollers (33 and 34) rotate. Simultaneously, the photoreceptors 2 in the four image forming units 1 are rotated.

Then, the charging device 6 charges the photoreceptor 2 uniformly, and the exposure device 40 exposes the photoreceptor 2, thereby forming an electrostatic latent image thereon. The developing device 8 develops the electrostatic latent image with toner, thereby forming a toner image. The primary-transfer rollers 35 transfers the toner images from the respective photoreceptors 2 and superimpose them one on another on the intermediate transfer belt 31, thereby forming a multicolor toner image on the intermediate transfer belt 31. The multicolor toner image is transported to the secondary-transfer nip N as the intermediate transfer belt 31 looped around the multiple rollers rotates.

Meanwhile, in the sheet tray 100, a feed roller 100*a* forwards the sheet P therefrom by rotating. The sheet P is separated one by one by a separating roller and fed to the sheet conveyance channel. The sheet P is transported by conveyance rollers 101 and caught in a nip between registration rollers 102.

The registration rollers 102 rotate to transport the sheet P to the secondary-transfer nip N, time to coincide with the arrival of the multicolor toner image formed on the intermediate transfer belt 31. In the secondary-transfer nip N, the toner image is transferred from the intermediate transfer belt 31 onto the sheet P by a transfer electrical field generated between the secondary-transfer roller 36 and the secondary-transfer backup roller 33. Subsequently, the intermediate-transfer cleaner 37 removes toner remaining on the intermediate transfer belt 31, and the four image forming units 1 are prepared for subsequent image formation.

The sheet P is transported to the fixing device 90. In the fixing device 90, the toner image is fixed on the sheet P with heat and pressure in the nip where the pressure roller 92 presses against the heating roller 91.

Then, the sheet P is discharged by a pair of discharge rollers 57 and stacked on a discharge tray 58.

The developing device 8 is described in further detail below with reference to FIGS. 1 and 3 through 6.

The four developing devices 8Y, 8M, 8C, and 8K have a similar configuration except the color of toner used therein, and thus suffixes Y, M, C, K representing the respective colors are omitted in the description below and accompanying drawings.

Figure 3:
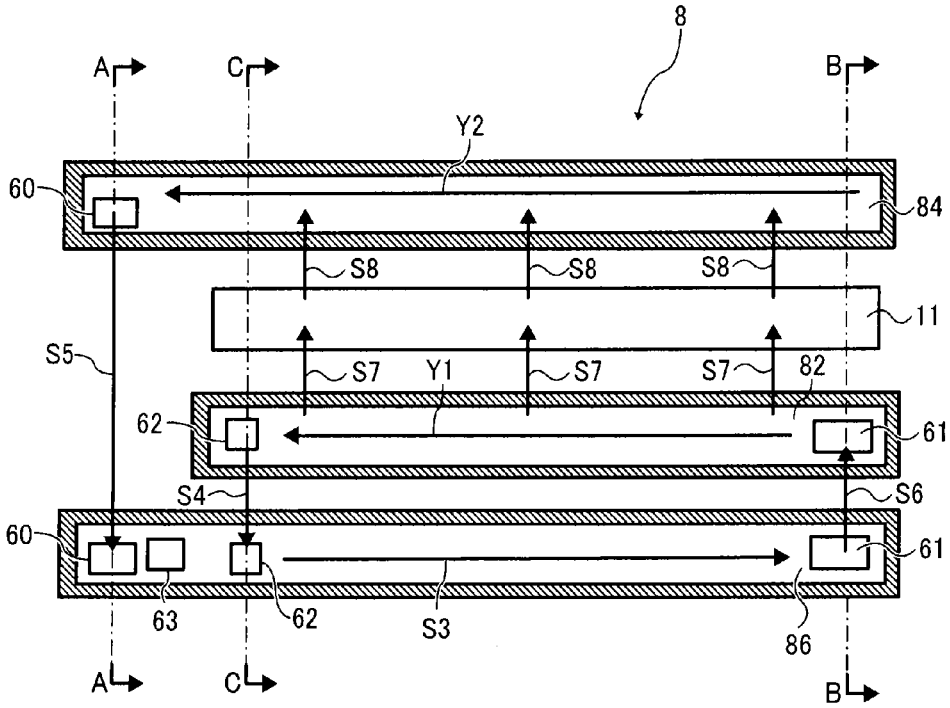
FIG. 3 illustrates circulation of developer in the developing device shown in FIG. 1.
Figure 4:
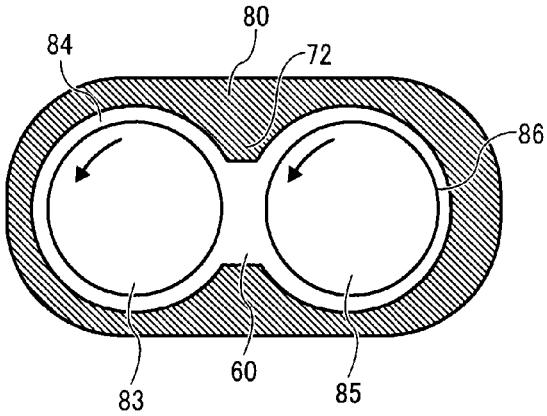
FIG. 4 is a cross sectional view along line A-A shown in FIG. 3.
Figure 6:
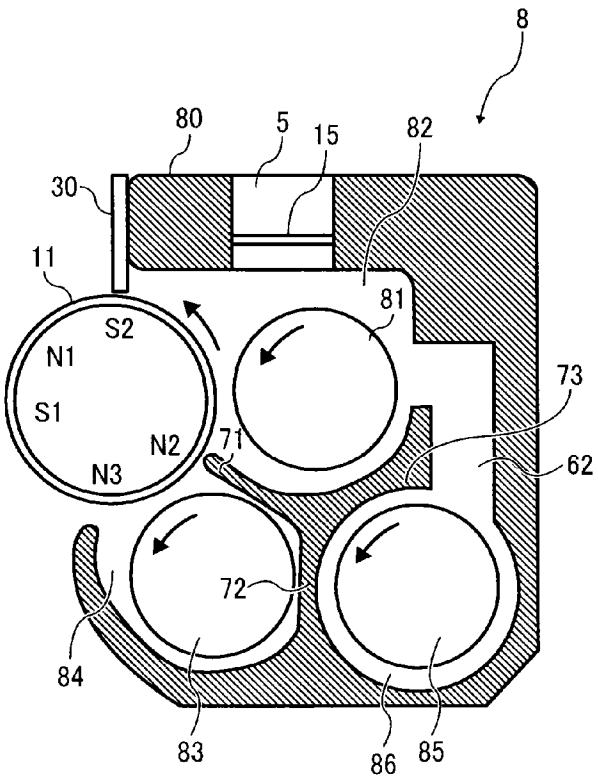
FIG. 6 is a cross sectional view along line C-C shown in FIG. 3.
Figure 5:
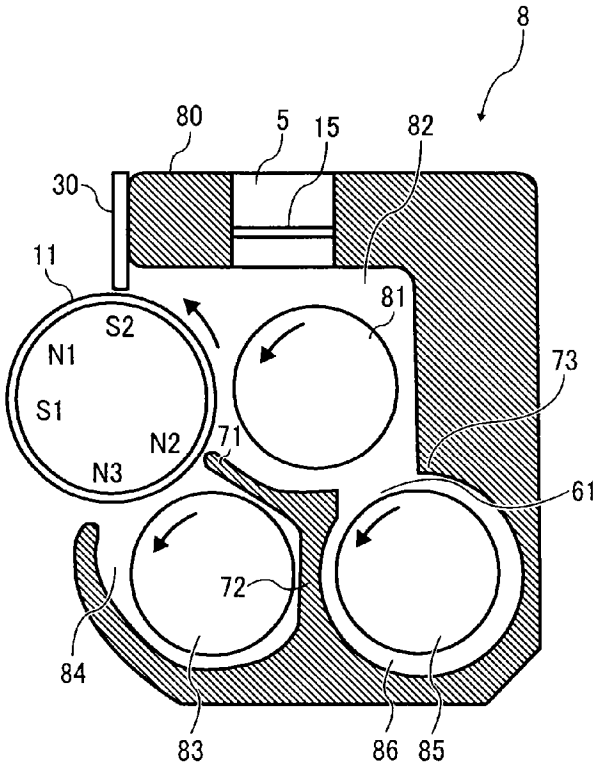
FIG. 5 is a cross sectional view along line B-B shown in FIG. 3.

FIG. 3 is a schematic diagram illustrating circulation of developer in the developing device 8. FIGS. 4, 5, and 6 are cross sectional views of the developing device 8 along line A-A, line B-B, and line C-C shown in FIG. 3, respectively.

The developing device 8 includes a developing roller 11 as a developer bearer and multiple developer conveying screws (i.e., developer conveyance members), namely, a supply screw 81, a collecting screw 83, and a circulation screw 85.

The developing roller 11 is cylindrical, and includes a sleeve that rotates counterclockwise in FIG. 1 and a magnet roller provided inside the sleeve. The sleeve can be constructed of a nonmagnetic material. The magnet roller is stationary relative to a development casing 80 serving as a developer container to contain developer. The magnet roller serves as a magnetic field generator and has five magnetic poles, N1, S1, N2, N3, and S2 at predetermined positions.

The development casing 80 is divided into a supply channel 82, a collecting channel 84, and a circulation channel 86 (collectively "developer containing channels"). The developing device 8 further includes a regulation blade 30. The regulation blade 30 is attached to the development casing 80 to face an upper portion of the developing roller 11 contactlessly with the developing roller 11. The regulation blade 30 is oriented to the surface of the sleeve adjacent to the magnetic pole S2 at a highest position of the magnet roller. The regulation blade 30 regulates the height of a magnetic brush of developer carried on the developing roller 11 and transported to a development range α, thereby regulating the amount of developer on the developing roller 11. In the present embodiment, the development casing 80 contains two-component developer (hereinafter simply "developer") including yellow, magenta, cyan, or black toner particles (also simply "toner") and magnetic carrier particle (also simply "carrier"). The development casing 80 is provided with an opening 89 (shown in FIG. 1) opposed to the photoreceptor 2, and the outer circumferential face of the developing roller 11 is partly exposed through the opening 89.

The sleeve of the developing roller 11 (hereinafter "developing sleeve") is disposed across a predetermined gap from the photoreceptor 2. In FIG. 1, the developing sleeve rotates counterclockwise, and the photoreceptor 2 rotates clockwise as indicated by arrows shown in FIG. 1. Thus, in the development range α, the developing sleeve and the photoreceptor 2 move in an identical direction.

The supply screw 81, the collecting screw 83, and the circulation screw 85 are respectively disposed in the supply channel 82, the collecting channel 84, and the circulation channel 86 inside the development casing 80.

In FIG. 3, arrow Y1 represents the direction in which developer is transported in the supply channel 82 by the supply screw 81 (hereinafter "conveyance direction of the supply screw 81"), and arrow Y2 represents the direction in which developer is transported in the collecting channel 84 by the collecting screw 83 (hereinafter "conveyance direction of the collecting screw 83"). Additionally, arrow S3 in FIG. 3 represents the direction in which developer is transported in the circulation channel 86 by the circulation screw 85 (hereinafter "conveyance direction of the circulation screw 85").

As shown in FIG. 1, a partition 71 is disposed between the supply channel 82 provided with the supply screw 81 and the collecting channel 84 provided with the collecting screw 83 to inhibit movement of developer therebetween. Additionally, a partition 72 is disposed between the collecting channel 84 and the circulation channel 86 provided with the circulation screw 85 to inhibit movement of developer therebetween. Further, a partition 73 is disposed between the circulation channel 86 and the supply channel 82 to inhibit movement of developer therebetween. In the developing device 8 shown in FIGS. 1, 3, and 6, the partitions 71, 72, and 73 are monolithic with the development casing 80. The developing roller 11 transports the developer supplied from the supply channel 82 to the development range α facing the photoreceptor 2.

The partitions 72 and 73 include communication openings to circulate developer among the supply channel 82, the collecting channel 84, and the circulation channel 86.

For example, as shown in FIGS. 3 and 4, the partition 72 separating the collecting channel 84 from the circulation channel 86 includes a communication opening 60 in a downstream end portion in the conveyance direction of the collecting screw 83, and developer is discharged through the communication opening 60 from the collecting channel 84 to the circulation channel 86.

As shown in FIGS. 3 and 5, the partition 73 separating the circulation channel 86 from the supply channel 82 includes a communication opening 61 in a downstream end portion in the conveyance direction of the circulation screw 85, and developer is discharged from the circulation channel 86 to the supply channel 82 through the communication opening 61. Further, as shown in FIGS. 3 and 6, the partition 73 includes a communication opening 62 in a downstream portion in the conveyance direction of the supply screw 81. At the downstream end of the supply channel 82 in the conveyance direction of the supply screw 81, developer is discharged through the communication opening 62 to the circulation channel 86 as indicated by arrow S4 shown in FIG. 3.

Arrow S5 shown in FIG. 3 indicates the direction of flow of developer discharged from the downstream end of the collecting channel 84 in the conveyance direction of the collecting screw 83 and received through the communication opening 60 in the circulation channel 86. Further, arrow S6 shown in FIG. 3 indicates the direction of flow of developer discharged from the downstream end of the circulation channel 86 in the conveyance direction of the circulation screw 85 and received through the communication opening 61 in the supply channel 82.

Additionally, a toner supply inlet 63, through which toner is supplied to the developing device 8, is provided adjacent to the upstream end of the circulation channel 86 in the conveyance direction of the circulation screw 85. Specifically, the toner supply inlet 63 is downstream from the communication opening 60 and upstream from the communication opening 62 in the conveyance direction of the circulation screw 85 in the circulation channel 86.

Both ends of each of the three developer conveying screws (81, 83, and 85) and the developing roller 11 are rotatably supported by the development casing 80. These components are rotated in the directions indicated by arrows shown in FIG. 1 by a driving unit including a driving source and a drive transmission mechanism.

The supply screw 81 supplies developer to the developing roller 11 while transporting and agitating the developer along its rotation shaft. The collecting screw 83 collects developer from the developing roller 11 while transporting and agitating the developer along its rotation shaft. Further, the circulation screw 85 mixes the toner supplied through the toner supply inlet 63 and the existing developer while transporting the developer along its rotation shaft.

The rotation shafts of the three developer conveying screws (81, 83, and 85) are parallel to the axis of rotation of the photoreceptor 2. In a vertical direction in FIG. 1, the supply screw 81 is positioned higher than the collecting screw 83 and the circulation screw 85. Driven by driving force from the drive source, these developer conveying screws rotate and transport developer inside the developing device 8. Then, developer is circulated inside the development casing 80 as indicated by arrows Y1, Y2, and S3 through S6.

While transporting developer in the supply channel 82, the supply screw 81 supplies the developer to the developing roller 11 as indicated by arrows S7, and the developer is scooped up to the surface of the developing roller 11 by the magnetic pole N2. Then, the developer is retained on the surface of the developing roller 11 and becomes the magnetic brush due to the magnetic force exerted by the magnet roller inside the developing roller 11. As the developing sleeve rotates, the developer retained on the surface of the developing roller 11 is transported from a position facing the magnetic pole S2 to a position facing the magnetic pole N1 and further to a position facing the magnetic pole S1. Then, the developer reaches the development range α where the developing roller 11 faces the photoreceptor 2. During the transportation, while the developer retained by the magnetic force exerted by the magnetic pole S2 passes through the portion facing the regulation blade 30, the developer is regulated into a thin layer. The developer blocked by the regulation blade 30 is returned to the supply channel 82.

The magnetic pole S1 is a main development pole and causes developer to stand on end in the development range α. Then, the developer contacts the surface of the photoreceptor 2 and develops the electrostatic latent image on the photoreceptor 2. After developing the latent image, the developer leaves the development range α and returns into the development casing 80 as the developing sleeve rotates. Then, the developer is separated from the surface of the developing roller 11 by a repulsive magnetic field between the magnetic poles N2 and N3 and collected in the collecting channel 84.

Meanwhile, a part of the developer inside the supply channel 82 is not supplied to the developing roller 11 and transported to the development range α but is transported by the supply screw 81 to or adjacent to the downstream end of the supply channel 82 in the developer conveyance direction therein.

As shown in FIG. 6, an entrance of the communication opening 62, which is adjacent to the downstream end of the supply channel 82 in the conveyance direction of the supply screw 81, is positioned higher than a lowest position in the supply channel 82.

Out of the developer transported inside the supply channel 82 by the supply screw 81 to the position adjacent to the communication opening 62, the developer at or higher than a lowest portion of the entrance of the communication opening 62 falls therethrough to the circulation channel 86.

By contrast, out of the developer transported to the communication opening 62, the developer that does not reach the lowest portion of the entrance of the communication opening 62 is supplied to the developing roller 11 while transported further downstream by the supply screw 81. Accordingly, on the downstream side in the supply channel 82, the bulk of developer decreases gradually and becomes lower than a lowest portion of the supply screw 81.

Although the bulk of developer may increase at the extreme downstream of the supply channel 82 that is a dead end, the developer returns to the communication opening 62 against the conveyance force of the supply screw 81 when the developer acculturates to a certain level. Then, the developer at or higher than the lowest portion of the entrance of the communication opening 62 falls therethrough to the circulation channel 86.

With this behavior, in the supply channel 82, the bulk of developer does not keep increasing downstream from the communication opening 62, and the developer reaches a state of equilibrium having a gradient adjacent to the extreme downstream of the communication opening 62.

The developer carried through the development range α by the developing roller 11 and deprived of toner is collected from the developing roller 11 into the collecting channel 84 as indicated by arrow S8 shown in FIG. 3. The developer inside the collecting channel 84 is agitated and transported downstream in the conveyance direction of the collecting screw 83. Then, the developer moves from the downstream end portion of the collecting channel 84 through the communication opening 60 to the circulation channel 86. In the circulation channel 86, while transported by the circulation screw 85, the developer is mixed with the toner supplied from the toner supply inlet 63 and further with the developer falling through the communication opening 62 from the supply channel 82. In the circulation channel 86, the circulation screw 85 transports developer downstream (to the right in FIG. 3).

In the circulation channel 86, within the width of an image area in which latent images are formed on the photoreceptor 2, developer is transported and agitated in a state closed by the partitions 72 and 73 to inhibit the developer from being mixed with the developer being transported by the other screws.

In the downstream end portion of the circulation channel 86 in the conveyance direction of the circulation screw 85, the communication opening 61 opens upward, and the circulation screw 85 lifts the developer inside the circulation channel 86 through the communication opening 61 to the supply channel 82.

Next, a distinctive feature of the present embodiment is described below.

As shown in FIG. 1 and the like, the developing device 8 further includes a pressure-release vent 5 above the supply channel 82 in the development casing 80, and a pressure-release filter 15 is provided to the pressure-release vent 5. In the present embodiment, the pressure-release filter 15 includes a porous fluoroplastic film such as a porous PFA (copolymer of tetrafluoroethylene and perfluoroalkyl vinyl ether) film.

When the developing device 8 is driven, the pressure (i.e., internal pressure) inside the development casing 80 (the supply channel 82, the collecting channel 84, and the circulation channel 86) rises. With the internal pressure rise, air flows from the developer containing channels toward the outside the development casing 80 through the pressure-release vent 5, and thus air flows out the development casing 80. Accordingly, the internal pressure rise can be inhibited, and toner scattering resulting therefrom can be inhibited. Additionally, the pressure-release filter 15 provided to the pressure-release vent 5 can inhibit toner and carrier from flowing out the development casing 80 together with air.

Although filters constructed of raising (or napped) materials, sponge, or the like are conventionally provided to pressure-release vents, toner and carrier filtered by the filter are likely to remain on the inner face of the filter facing the developer containing channels, thus clogging the filter. Clogging of the pressure-release filter 15 increases pressure loss when air passes through the pressure-release filter 15. If the pressure loss increases, it degrades the efficiency in discharging air when the internal pressure of the developer containing channels rises, and the pressure rise is not suppressed sufficiently. Thus, toner scattering arises.

By contrast, in the developing device 8 according to the present embodiment, the pressure-release filter 15 is constructed of the porous fluoroplastic film. The surface of porous fluoroplastic film is smooth and has a high capability to release toner and carrier. Accordingly, even when toner filtered adheres to the inner face of the pressure-release filter 15 opposed to the developer containing channels, the toner is not likely to remain thereon. Accordingly, accumulation of toner and carrier on the pressure-release filter 15 and clogging of the pressure-release filter 15 caused thereby can be inhibited. Therefore, the developing device 8 according to the present embodiment can inhibit clogging of the pressure-release filter 15 and suppress toner scattering caused by the internal pressure rise resulting from the clogged pressure-release filter 15.

It is to be noted that, the porous fluoroplastic for the pressure-release filter 15 is not limited to porous PFA but can include other types of porous fluoroplastic such as porous PTFE (polytetrafluoroethylene).

Figure 7A:
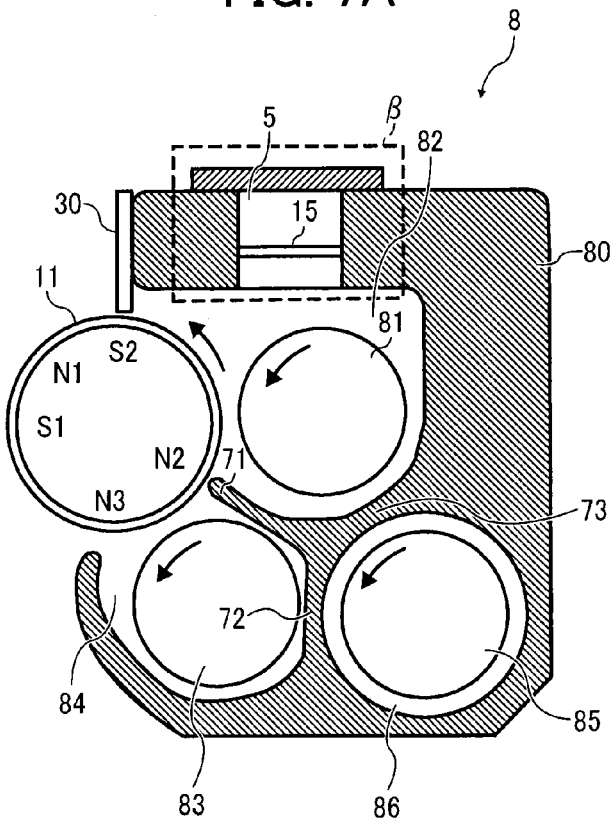
FIG. 7A is a cross-sectional view of a developing device provided with a pressure-release filter according to an embodiment.

The pressure-release filter 15 is described in further detail below. FIG. 7A is a cross-sectional view of the developing device 8 provided with the pressure-release filter 15, FIG. 7B is an enlarged view of a range β shown in FIG. 7A, and FIG. 7C is a perspective view of the pressure-release filter 15.

In the present embodiment, the porous PFA used for the pressure-release filter 15 has a pore diameter of 10 μm or smaller. When the average particle size of toner is smaller than 10 μm, it is preferred that the pore diameter of the porous PFA is smaller than that of toner. This configuration can inhibit toner from passing through the pressure-release filter 15, thus suppressing toner scattering.

It is to be noted that, when the pore diameter of the porous PFA is 10 μm or smaller, the passage of carrier included in two-component developer can be prevented reliably.

Figure 7B:
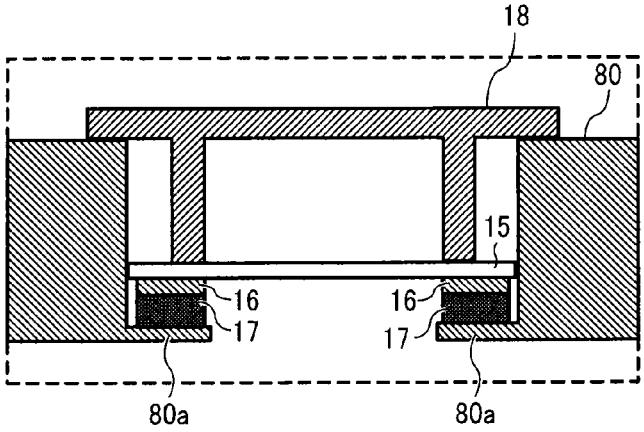
FIG. 7B is an enlarged view of a range β shown in FIG. 7A.
Figure 7C:
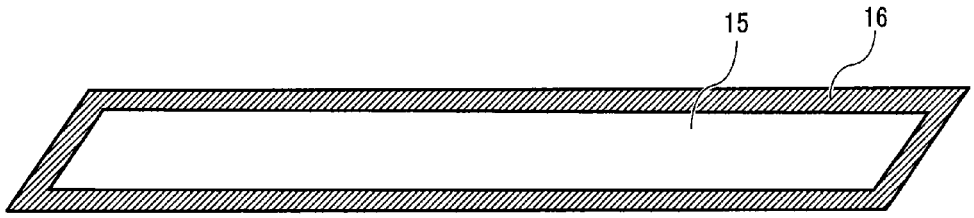
FIG. 7C is a perspective view of the pressure-release filter shown in FIG. 7A.

Referring to FIG. 7B, further a reinforcing member 16 is provided to the inner face of the pressure-release filter 15 facing the interior of the developing device 8 (i.e., the developer containing channels), at or adjacent to the periphery of the pressure-release filter 15, to maintain the shape of the film-shaped pressure-release filter 15. For example, the reinforcing member 16 has a thickness of about 0.3 mm and is constructed of PET (polyethylene terephthalate). The reinforcing member 16 may be bonded to the pressure-release filter 15.

Reinforcing the pressure-release filter 15 with the reinforcing member 16 to maintain the shape of the pressure-release filter 15 to cover the pressure-release vent 5 is advantageous in facilitating removal of the pressure-release filter 15 from the development casing 80 and accordingly enhancing maintenance of the developing device 8 and replacement of the pressure-release filter 15.

As shown in FIG. 7C, the reinforcing member 16 is attached to the pressure-release filter 15 along the periphery of the pressure-release filter 15, and it helps to maintain the shape of the pressure-release filter 15. Although the reinforcement with the reinforcing member 16 means a reduction in the area of the pressure-release filter 15 through which air passes, the decrease can be alleviated by providing the reinforcing member 16 at or adjacent to the periphery of the pressure-release filter 15.

Additionally, as shown in FIG. 7B, the pressure-release filter 15 is attached, via the reinforcing member 16, to an edge portion 80*a* of the development casing 80 enclosing the pressure-release vent 5. Between the reinforcing member 16 and the edge portion 80*a*, a compressed sponge member 17, serving as a compressed member, is provided to seal clearance therebetween. In the present embodiment, for example, the sponge member 17 is constructed of urethane and has a thickness of about 2.0 mm when not being compressed.

The pressure-release filter 15 and related components are disposed as follows. Place the sponge member 17 on the edge portion 80*a*. Then, dispose the pressure-release filter 15 to which the reinforcing member 16 is attached on the sponge member 17. Further, attach a filter case 18 to the development casing 80 from outside the pressure-release vent 5 so that the filter case 18 presses down the reinforcing member 16 with the pressure-release filter 15 interposed therebetween. Then, the sponge member 17 is compressed to about 1.0 mm, being interposed between the reinforcing member 16 and the edge portion 80*a*. With the sponge member 17 compressed and interposed between the adjacent components in the portion where the pressure-release filter 15 is provided, sealing of the developing device 8 at the pressure-release vent 5 can be secured.

The image forming apparatus 500 further includes an exhaust duct, and air inside the apparatus is discharged by a negative pressure generator, such as an exhaust fan, through the exhaust duct to the outside. The filter case 18 shown in FIG. 7B communicates with the exhaust duct, and the internal pressure of the developing device 8 is reduced by sucking air from the exhaust duct by the negative pressure generator.

In the present embodiment, since the reinforcing member 16 is attached (may be bonded) to the pressure-release filter 15 and the pressure-release filter 15 is made removable, clogging of the pressure-release filter 15 with developer can be eliminated by regular cleaning or replacement of the pressure-release filter 15. The pressure loss at the pressure-release vent 5 can be inhibited by canceling the clogging of the pressure-release filter 15, which can inhibit scattering of toner caused by the internal pressure rise of the developer container. Additionally, the maintenance of the developing device 8 can become easier.

Additionally, it is preferable that the pressure-release filter 15 be double-structured and a thin film of a typical filter material, such as raising materials, sponge, or the like, be attached to a porous fluoroplastic film.

Figure 8:
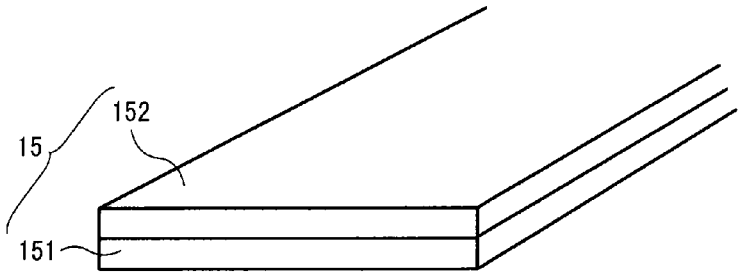
FIG. 8 is an enlarged perspective view illustrating double-layered filter as a variation of the pressure-release filter shown in FIGS. 7A through 7C.

FIG. 8 illustrating a variation of the pressure-release filter 15 according to the present embodiment. In the configuration shown in FIG. 8, the pressure-release filter 15 be double-structured and includes a porous fluoroplastic layer 151 and a raising material layer 152. Instead of the raising material layer 152, sponge or the like may be provided on the porous fluoroplastic layer 151.

When the pressure-release filter 15 is double-structured as shown in FIG. 8, the pressure-release filter 15 is disposed with the porous fluoroplastic layer 151 facing the inner side of the development casing 80 and the raising material layer 152 (or sponge, or the like) facing the outer side of the development casing 80.

While the porous fluoroplastic film excels in surface smoothness and capability to release toner, its shape is unstable since it is film shaped. Accordingly, an inner area surrounded by the reinforcing member 16 is likely to deform, being pressed by the airflow passing through the pressure-release vent 5. If the pressure-release filter 15 is repeatedly deformed by the airflow each time the developing device 8 is driven, there is a risk that the porous fluoroplastic film is damaged, thus degrading the capability of the pressure-release filter 15.

By contrast, when the pressure-release filter 15 is double-structured as shown in FIG. 8 and the raising material layer 152 (or sponge, or the like) is provided on the outer side, the inner area of the porous fluoroplastic film can be pressed from the opposite side of the developer containing channels.

This configuration can inhibit deformation of the porous fluoroplastic film pressed by the airflow and accordingly reduce the resulting damage to the porous fluoroplastic film.

If the double-structured pressure-release filter 15 is disposed inside out such that the raising material layer 152 (or sponge, or the like) is opposed to the developer containing channels, clogging arises similarly to conventional filters. By contrast, when the reinforcing member 16 is provided to the porous fluoroplastic layer 151 of the pressure-release filter 15, the reinforcing member 16 can be a mark to distinguish the porous fluoroplastic layer 151. Accordingly, it can be a preventive to inhibit the raising material layer 152 (or sponge, or the like) from being disposed on the side of the developer containing channels erroneously.

It is to be noted that, although most of toner particles can be blocked when the pore diameter of the porous fluoroplastic film is smaller than the average particle size of toner, it is possible that a part of toner particles pass through the pores in the porous fluoroplastic film.

When the pressure-release filter 15 is double-structured, such toner particles passing through the porous fluoroplastic layer 151 can be captured by the raising material layer 152 (or sponge, or the like). Thus, leak of toner from the pressure-release vent 5 can be inhibited more reliably.

The various configurations according to the present inventions can attain specific effects as follows.

Aspect A: Aspect A concerns a developing device, such as the developing device 8, that includes a developer bearer, such as the developing roller 11, to carry developer on its surface and supply by rotation developer to a latent image on a latent image bearer, such as the photoreceptor 2, in a development range facing the latent image bearer; a developer container, such as the development casing 80, to contain developer; a pressure-release vent, such as the pressure-release vent 5, in the developer container to discharge air from the developer container to outside the device, thereby inhibiting air pressure rises inside the developer container; and a filter, such as the pressure-release filter 15, provided to the pressure-release vent to inhibit developer from being discharged from the pressure-release vent. In this developing device, the filter is constructed of a porous fluoroplastic film.

As described above, since the porous fluoroplastic film excels in surface smoothness and capability to release developer, developer is not likely to remain thereon even when the developer filtered adheres to the face of the filter on the inner side of the developer container. Accordingly, accumulation of developer on the filter and clogging of the filter caused thereby can be inhibited. Thus, aspect A can inhibit the clogging of the filter provided to the pressure-release vent.

Aspect B: In aspect A, the porous fluoroplastic includes porous PFA.

As described above, this configuration enables the filter to inhibit clogging thereof resulting from the accumulation of developer thereon.

Aspect C: In aspect A or B, the filter, such as the pressure-release filter 15, is provided with a reinforcing member such as the reinforcing member 16 so that the filter maintains the shape to cover the pressure-release vent.

According to aspect C, as described above, the porous fluoroplastic film that is film-shaped and is not handled easily can be reinforced to maintain its shape, thus facilitating the handling thereof. Accordingly, removal of the filter can be easier, and maintenance and replacement can be facilitated.

Aspect D: In aspect C, the reinforcing member is attached to the filter along the periphery of the filter.

As described above, this configuration contributes to maintaining the shape of the filter and simultaneously alleviates the reduction in the area of the filter through which air passes.

Aspect E: In aspect C or D, the filter is provided to the developer container, such as the development casing 80, via the reinforcing member, and the clearance between the reinforcing member and the developer container is sealed with a compressed member, such as the sponge member 17.

With this configuration, as described above, sealing of the portion where the filter is provided can be secured, and simultaneously, removal of the filter can be easy.

Aspect F: A process cartridge, such as the image forming unit 1, removably installed in an image forming apparatus includes the developing device according to any of aspects A through E and at least one of the latent image bearer, such as the photoreceptor 2, a charging member, such as the charging device 6, to charge the latent image bearer, and a cleaning device, such as the cleaning device 3, to clean the latent image bearer.

As described above, aspect F can attain, as the developing device incorporated in the process cartridge, a developing device capable of inhibiting clogging of the filter provided to the pressure-release vent.

Aspect G: In an image forming apparatus that includes the latent image bearer, such as the photoreceptor 2; a latent image forming unit, such as the exposure device 40, to form a latent image on the latent image bearer; a transfer member, such as the primary-transfer roller 35, the intermediate transfer belt 31, and the secondary-transfer roller 36, to transfer a toner image from the latent image bearer onto a sheet of recording media; the developing device according to any of aspects A through E is used.

According to aspect G, as described above, since the clogging of the filter provided to the pressure-release vent can be inhibited, reliable image formation can be secured with toner scattering resulting from the clogging suppressed.

Aspect H: In an image forming apparatus including the latent image bearer, such as the photoreceptor 2, the charging member such as the charging device 6 to charge the latent image bearer, the developing device to develop the latent image on the latent image bearer into a toner image, the cleaning device such as the cleaning device 3 to clean the latent image bearer, the transfer member, such as the primary-transfer roller 35, the intermediate transfer belt 31, and the secondary-transfer roller 36, to transfer the toner image from the latent image bearer onto a sheet of recording media; multiple process cartridges according to aspect F are used.

According to aspect H, since the image forming apparatus includes the multiple process cartridges incorporating the developing device capable of inhibiting toner scattering resulting from the clogging of the filter, color image formation can be reliable.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to carry by rotation developer to a development range facing a latent image bearer;

a developer container to contain developer and having a pressure-release vent to discharge air from the developer container to outside the developing device;

a filter provided to the pressure-release vent to inhibit developer from being discharged through the pressure-release vent, the filter including a porous fluoroplastic film; and a reinforcing member to reinforce the filter to maintain a shape of the filter to cover the pressure-release vent, wherein the filter is provided to the developer container via the reinforcing member, wherein a compressed member is provided between the reinforcing member and the developer container to seal clearance therebetween, wherein the compressed member is a sponge, and wherein the reinforcing member is thin and planar.

2. The developing device according to claim 1, wherein the porous fluoroplastic film comprises a porous PFA film.

3. The developing device according to claim 1, wherein the reinforcing member is bonded to the filter along a periphery of the filter.

4. A process cartridge removably installed in an image forming apparatus, the process cartridge comprising:

the developing device according to claim 1; and at least one of the latent image bearer, a charging member to charge the latent image bearer, and a cleaning device to clean the latent image bearer.

5. An image forming apparatus comprising:

the latent image bearer;

a latent image forming unit to form a latent image on the latent image bearer;

the developing device according to claim 1, to develop the latent image into a toner image; and a transfer member to transfer the toner image onto a recording medium.

6. An image forming apparatus comprising multiple process cartridge removably installed in the image forming apparatus, the multiple process cartridges each including the developing device according to claim 1 and at least one of the latent image bearer, a charging member to charge the latent image bearer, and a cleaning device to clean the latent image bearer.

7. A developing device comprising:

a developer bearer to carry by rotation developer to a development range facing a latent image bearer;

a developer container to contain developer and having a pressure-release vent to discharge air from the developer container to outside the developing device; and a filter provided to the pressure-release vent to inhibit developer from being discharged through the pressure-release vent, the filter including a porous fluoroplastic film, wherein the filter further comprises a raising material attached to the porous fluoroplastic film.

8. A developing device comprising:

a developer bearer to carry by rotation developer to a development range facing a latent image bearer;

a developer container to contain developer and having a pressure-release vent to discharge air from the developer container to outside the developing device; and a filter provided to the pressure-release vent to inhibit developer from being discharged through the pressure-release vent, the filter including a porous fluoroplastic film, wherein the filter further comprises a raising material attached to the porous fluoroplastic film, and wherein the raising material is disposed facing an outer side of the developer container.

* * * * *